United States Patent [19]

Kuratani

[11] Patent Number: 5,068,499

[45] Date of Patent: Nov. 26, 1991

[54] CONTROL LEVER TYPE INPUT DEVICE

[75] Inventor: Junichi Kuratani, Miyagi, Japan

[73] Assignee: Alps Electric Co., Ltd., Tokyo, Japan

[21] Appl. No.: 497,058

[22] Filed: Mar. 21, 1990

[30] Foreign Application Priority Data

Apr. 14, 1989 [JP] Japan ..... 1-43100[U]
Apr. 14, 1989 [JP] Japan ..... 1-43101[U]

[51] Int. Cl.[5] ..... H01C 10/00; H01H 25/00
[52] U.S. Cl. ..... 200/6 A; 338/128
[58] Field of Search ..... 200/45 R, 6 A, 17 R, 200/18; 338/128-134; 74/471 R, 471 XY

[56] References Cited

U.S. PATENT DOCUMENTS 2,747,035 5/1956 Hansen et al. ..... 200/6 A X
3,293,381 12/1966 Eitel ..... 200/6 A
3,731,013 5/1973 Nightengale ..... 200/6 A X
4,245,137 1/1981 Hirai et al. ..... 200/6 A X
4,489,304 12/1984 Hayes ..... 338/128
4,559,420 12/1985 Yamada ..... 200/6 A

*Primary Examiner*—J. R. Scott
*Attorney, Agent, or Firm*—Guy W. Shoup; David W. Heid

[57] ABSTRACT

A control lever type input device is disclosed, which is provided with a plurality of input sections disposed on a casing; a control lever supported pivotably for driving the plurality of input sections; and a switch driven by driving the control lever so as to rotate in the peripheral direction thereof, wherein the plurality of input sections are driven selectively by inclining the control lever protruding from the casing in a predetermined direction.

7 Claims, 9 Drawing Sheets

CONTROL LEVER TYPE INPUT DEVICE

BACKGROUND OF THE INVENTION

The present invention relates to a control lever type input device, and in particular to a control lever type input device used for inputting coordinates in a navigation input device mounted in a vehicle.

FIG. 11 is a perspective view of a prior art control lever type input device.

In FIG. 11, reference numeral 1 is a box-shaped casing and 2 is a control lever. A spherical body 3 is disposed in the lower part of this control lever 2 and this spherical body 3 is engaged with a pivoting fulcrum 7 so that the control lever 2 is pivotable. Further two semicircular arc-shaped interlink plates (not shown in the figure) are mounted, crossed and superposed on each other, rotatable in the casing 1. A slit is formed in the longitudinal direction in each of the interlink plates and an extremity of the control lever 2 passes through the superposed part of these slits so as to be engaged therewith. 4 represents a pair of variable resistors mounted on two side walls adjacent to each other of the casing 1. The rotating shaft of each of these variable resistors 4, 4 is engaged with an interlink hole formed at an end of the respective interlink plate so that the plurality of resistors 4, 4 can be regulated simultaneously through the interlink plates. 6 is a switch, which is a rotary type switch incorporated in the knob portion located at the upper extremity of the control lever 2. When this switch 6 is manipulated, e.g. a cursor, which moves on a display, is inputted by manipulating the control lever 2 so as to be inclined.

According to the prior art technique described above, since the rotary type switch 6 was incorporated in the knob portion of the control lever 2, the knob portion was large and it looked bad in the aspect. Further, for wiring the switch, leads should be soldered, passing through the control lever 2. Therefore the wiring was troublesome and the quality was unstable.

OBJECT OF THE INVENTION

The present invention has been done, in view of the problems of the prior art technique described above, in order to solve them, and the object thereof is to provide a control lever type input device capable of reducing the size of the knob, which needs no treatment for the harness and assures a stable quality.

SUMMARY OF THE INVENTION

In order to achieve the above object, a control lever type input device according to the present invention is provided with a plurality of input sections disposed on a casing; a control lever supported pivotably for driving the plurality of input sections; and a switch driven by driving the control lever so as to rotate in the peripheral direction thereof, the plurality of input sections being driven selectively by inclining the control lever protruding from the casing in a predetermined direction; wherein the shaft of each of the plurality of input sections consists of an outer shaft and an inner shaft; a rotating plate is secured to each of the outer shaft and the inner shaft; a base plate is mounted fixedly on the casing so as to be opposite to the respective rotating plate; a contact pattern is formed on the rotating plate; a slider is disposed fixedly on one side surface between the rotating plate and the base plate as well as between the two rotating plates; conductive parts on the two surfaces of one of the rotating plates are electrically connected; and a driving member disposed on the control lever is engaged with the outer shaft or the inner shaft so as to be rotated by the rotating drive of the control lever.

Further, the control lever is supported rotatably and at the same time a driving member is fixed; an outer shaft is mounted rotatably on a driving shaft of each of the input sections; a variable resistor is disposed on each of the outer shaft and the driving shaft; the driving member is linked with the outer shaft; and the rotating angle of the outer shaft and that of the driving shaft are made different from each other by driving the control lever so as to be rotated so that a difference is produced in the output of the two variable resistors.

By using the means described above, each of the input sections is driven selectively by manipulating the control lever so as to be inclined. On the other hand, the switch is driven through the driving member by manipulating the control lever so as to be rotated. Consequently the knob of the control lever can be small and the quality can be stabilized without treatment of the harness.

DETAILED DESCRIPTION

Figure 1:
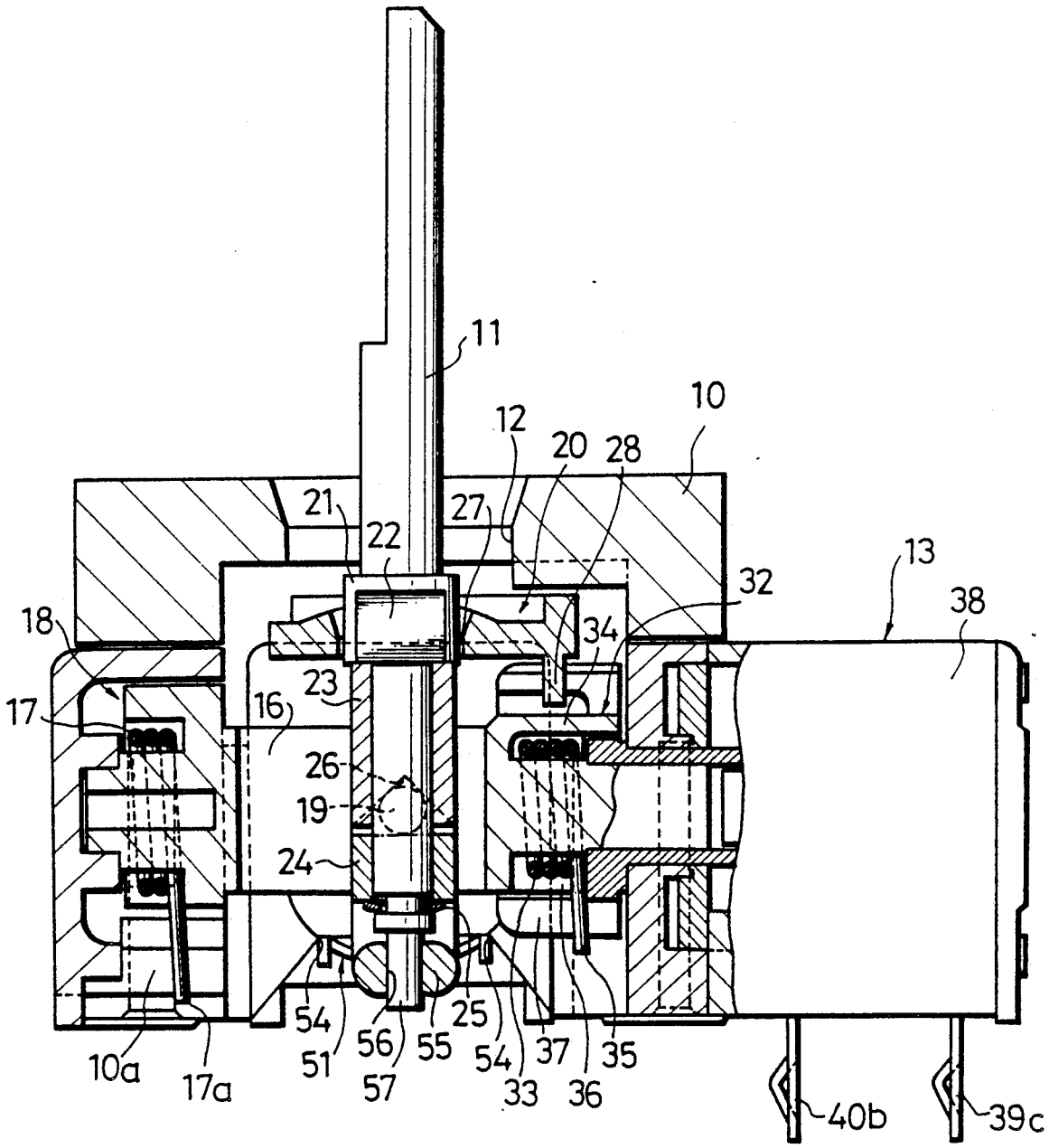
FIG. 1 is a side view of a control lever type input device according to the present invention, partly cut away.

In FIGS. 1 to 10, reference numeral 10 represents a box-shaped casing. On the upper plate of the casing 10, there is disposed an opening portion 12, from which a control lever 11 protrudes. Further variable resistors 13 and 14 are mounted on two side plate portions adjacent to each other.

Reference numeral 15 represents a driving shaft. This driving shaft 15 is horizontally mounted rotatably on the casing 10. The rotating plate of one of the variable resistors 13 is secured to one end of this driving shaft 15. Further, an athletic-track-shaped through hole 16, whose longitudinal direction is parallel to the axis of the shaft, is formed in the driving shaft 15, the center line of the through hole being perpendicular to the axis of the shaft. At one end portion of the driving shaft 15, there is disposed an automatic returning mechanism 18, this automatic returning mechanism 18 having a coil spring 17. The driving shaft 15 is inserted in the helical portion of this coil spring 17. The two ends 17*a* of the coil spring 17 are engaged with engaging portions 10*a* disposed at the bottom portion of the casing 10 and at the same time the engaging portions of the mounting portion of the driving shaft 15, which are opposite to each other, are brought into contact with the two ends of the coil spring 17. Consequently, when it is not manipulated, the two ends of the coil spring 17 are thrusted elastically towards the engaging portions 10*a* of the casing 10 and the two ends 17*a* of the coil spring 17 in this state are brought into contact with the engaging portions of the driving shaft 15 so that the driving shaft 15 is kept at a predetermined position. On the other hand, on the inner surface portions of the through hole 16, which are opposite to each other, there are disposed shaft supporting protrusions 19, 19, protruding therefrom. The control lever 11 is supported rotatably by these protrusions 19, 19.

A mounting portion 21 securing a working member 20 by engaging it therewith is formed at the approximately central portion of the control lever 11. A pair of plane portions 22, 22 are formed on the outer peripheral surface of this mounting portion 21. Further the lower member of the control lever 11 is inserted in bearing rings 23 and 24 and these rings 23 and 24 are fastened by a washer 25 so as not to fall out therefrom. A pair of triangular cut-off portions 26, 26 are formed in this ring 23 from the lowest end portions thereof and the shaft supporting protrusions 19 and 19 described above are brought into contact with these cut-off portions 26 and 26, respectively. Further the upper end surface of the ring 24 is brought into contact with the shaft supporting protrusions 19, 19 so that each of the cut-off portions 26 and 26 of the ring 23 and the upper end surface of the ring 24 constitute a bearing for each of the shaft supporting protrusions 19 and 19. In this way, the control lever 11 is arranged perpendicularly to the driving shaft 15. Therefore the control lever 11 is pivotable around the shaft supporting protrusion 19 and rotatable by means of the rings 23 and 24.

The working member 20 has an athletic track shape and a mounting hole 27, which is rectangular, corresponding to the shape of the mounting portion 21 described above, is formed at the central portion thereof. Further a working protrusion 28 is disposed on the lower end surface of the working member 20, protruding therefrom. This working protrusion 28 is engaged with the outer shaft 29, which is driven so as to be rotated through the working protrusion 28 by the rotational movement of the working member 20.

The outer shaft 29 has a hollow shaft shape and the driving shaft 15 is inserted therein. At one end of this outer shaft 29, there is disposed an engaging recess portion 30 engaged with the working protrusion 28 of the working member 20 described above. At the bottom portion of this engaging recess portion 30, there is disposed a stopping piece 31 restricting the domain of the rotation of the outer shaft 29, extending from the driving shaft 15. Further an automatic returning mechanism 32 is disposed between one end of the outer shaft 29 and the driving shaft 15 described above. This automatic returning mechanism 32 includes an automatic return coil spring 33 and the mounting portion 34 of the driving shaft 15 is inserted in the helical portion of this coil spring 33. Further the two end portions 35, 35 of the coil spring 33 are brought into contact with stopping portions 36, 36 disposed on the driving shaft 15 and the two end portions 35 and 35 extending further are brought into contact with a pair of stopping portions 37 and 37 disposed on the outer shaft 29, respectively. Consequently, when it is not manipulated, the outer shaft 29 is set by the two end portions 35, 35 of the coil spring 33 at a predetermined position with respect to the driving shaft 15, i.e. in the case of the present invention, at a position where a switching contact mechanism consisting of the rotating plate of the variable resistor 13 rotated by the driving shaft 15 and the rotating plate rotated by the outer shaft 29 is in the non-conductive state, i.e. OFF state.

Figure 5:
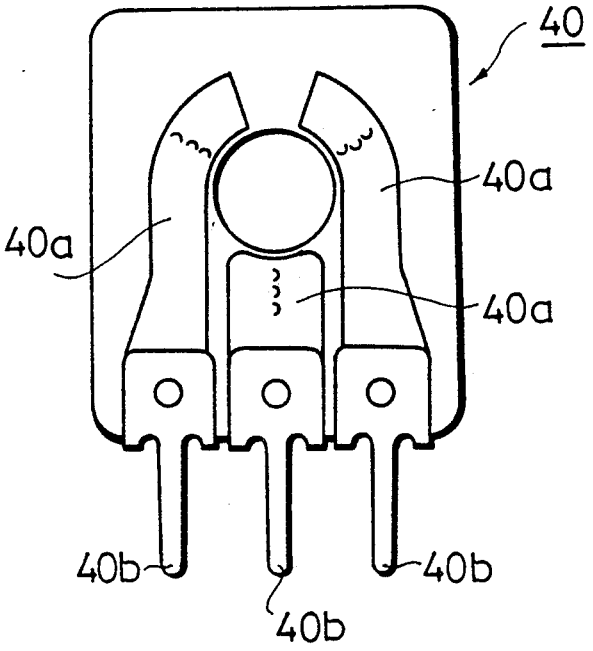
FIGS. 5 to 8 illustrate various parts of the variable resistors indicated in FIG. 4, FIG. 5 being a front view of a base plate, FIG. 6 being a front view of a rotating plate, FIGS. 7A and 7B being a front view and a rear view of the other rotating plate, respectively, FIG. 8 being a front view of the other base plate.
Figure 6:
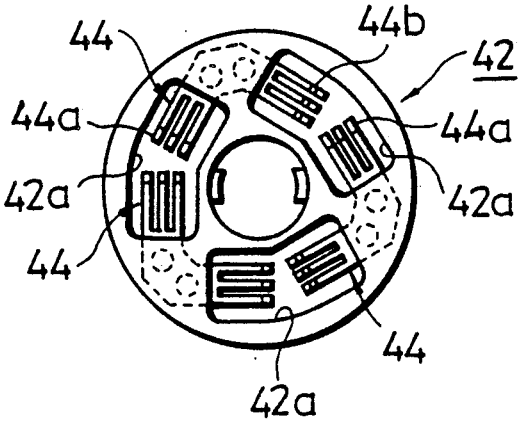
Figure 7A:
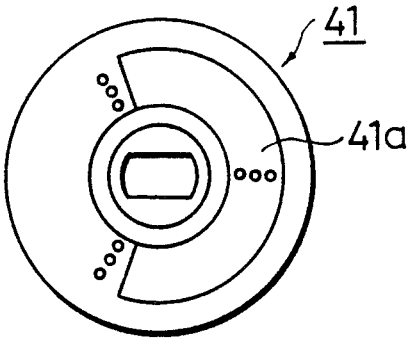
Figure 7B:
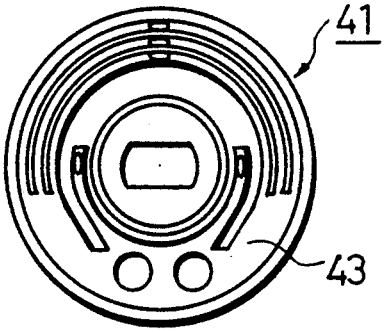
Figure 8:
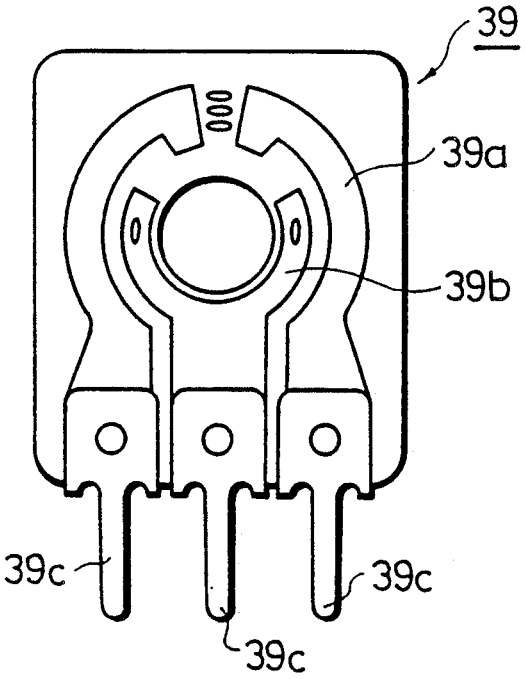

This variable resistor 13 is disposed in a case 38 secured to the casing 10. Reference numeral 39 is a base plate, on which a resistor pattern 39*a* and a conductor pattern 39*b* are formed, as indicated in FIG. 8, and 40 is a base plate, on which a conductor pattern 40*a* is formed, as indicated in FIG. 5. These base plates 39 and 40 are mounted fixedly on the inner wall surface of the case 38, 41 and 42 are rotating plates, e.g. slider holder. The slider holder 41 is mounted fixedly on the driving shaft 15 and a slider 43 sliding on the resistor pattern 39*a* and the conductor pattern 39*b* on the base plate 39 to vary the resistance is secured to one surface of the slider holder 41. Further, on the other surface of this slider holder 41, there is formed a switching contact pattern 41*a*, as indicated in FIGS. 7A and 7B. On the other hand, the slider holder 42 is mounted fixedly on the outer shaft 29. Opening portions 42*a*, 42*a* are formed with an equal interval in the slider holder 42 as indicated in FIG. 6. The base plate portion of the slider 44 is buried between every two opening portions 42*a* adjacent to each other and sliding portions 44*a* and 44*b* bent and extending from the slider 44 in the adjacent opening portions 42*a*, 42*a* are formed alternately on the two surfaces. This sliding portion 44*a* is slid on the contact pattern 41*a* of the slider holder 41 and the sliding portion 44*b* is slid on the conductor pattern 40*a* of the base plate 40. Consequently, the angle formed by the outer shaft 29 are the driving shaft 15 is varied by twisting manipulation of the control lever 11 so that the contact between the contact pattern 41*a* of the slider holder 41 and the slider 44 is turned on and off. In this way, the output of the switch is led from the slider 44 to the conductor pattern 40*a* of the substrate 40 and outputted through base plate 39.

Further the variable resistor 14 is disposed in the case 45 secured to the casing 10. 46 represents a base plate, on which a resistor layer and a conductor layer are formed in the form of patterns. This base plate 46 is mounted fixedly on the inner wall surface of the case 45, 47 is a slider holder. An elastic slider 48 is secured to this slider holder 47. This slider 48 is thrusted towards the base plate 46 with pressure and slid on the patterns. This slider holder 47 is engaged with a rotating plate 50 by protrusion-recess engagement, in which a small driving shaft 49 is inserted to be fixed thereto, so that the slider holder 47 is rotated by the rotation of the small driving shaft 49.

On the side plate, which is opposite to the side plate of the casing, on which this variable resistor 14 is mounted, there is disposed an automatic returning mechanism 51, which returns automatically the variable resistor 14. This automatic returning mechanism 51 includes a coil spring 52 and a mounting portion 53, around which the helical part of this coil spring 52 is mounted, and it is composed of a rotating shaft 53 supported rotatably by the casing and stopping portions 54 and 54, with which the two ends of the coil spring 52 stated above are engaged, respectively. This rotating shaft 53 and the small driving shaft 49 stated above are arranged on a same axis, which is perpendicular to the axis of the driving shaft 15. The two ends of a U-shaped interlink plate 55 are engaged with the end portions of the rotating shaft 53 and the small driving shaft 49, which are opposite to each other so that the rotating shaft 53 and the small driving shaft 49 are rotated in one body. An elongated groove 56 is formed at the central portion, which is the bottom plate of this interlink plate 55, and the lower end portion 57 of the control lever 11 described above is inserted in this elongated groove 56. In this way, in FIG. 1, when the control lever 11 is pivoted around the protrusion 19, the interlink plate 55 is similarly rotated so that the small driving shaft 49 and the rotating shaft 53 are driven to be rotated. Further the small driving shaft 49, the rotating shaft 53 and the interlink plate 53 may be not separate members, but it may be constructed in one body.

FIG. 1 shows the state, when the device is not manipulated, where the variable resistors 13 and 14 are set at the neutral position by the automatic returning mechanisms 18, 32 and 51. Further the control lever 11 is set also at the neutral position. Starting from the state indicated in FIG. 1, a force is applied to the extremity of the control lever 11 towards the right, the control lever 11 is pivoted clockwise around the shaft supporting protrusion 19 and the small driving shaft 49 is rotated through the interlink plate 55 engaged with the lower end portion 57 of the control lever 11 so that the output value of the variable resistor 14 is regulated. On the other hand, when a force is applied to the extremity portion in the direction perpendicular to the sheet of paper, the control lever 11 is pivoted around the driving shaft 15 and the driving shaft 15 is rotated so that the output value of the variable resistor 13 is regulated. In this way, it is possible to regulate selectively the variable resistors 13 and 14 by inclining the control lever 11 in an arbitrary direction. Further, when the manipulating force is removed, the control lever 11 is returned to the state indicated in FIG. 1 by the automatic returning mechanism 18.

When the control lever 11 is moved to be inclined in such a way, if the control lever is not manipulated to be rotated, the outer shaft 29, in which the driving shaft 15 is inserted, is rotated in one body together with the rotation of the driving shaft 15 by the automatic returning mechanism 52.

Next the rotating operation of the control lever 11 will be explained.

Figure 2:
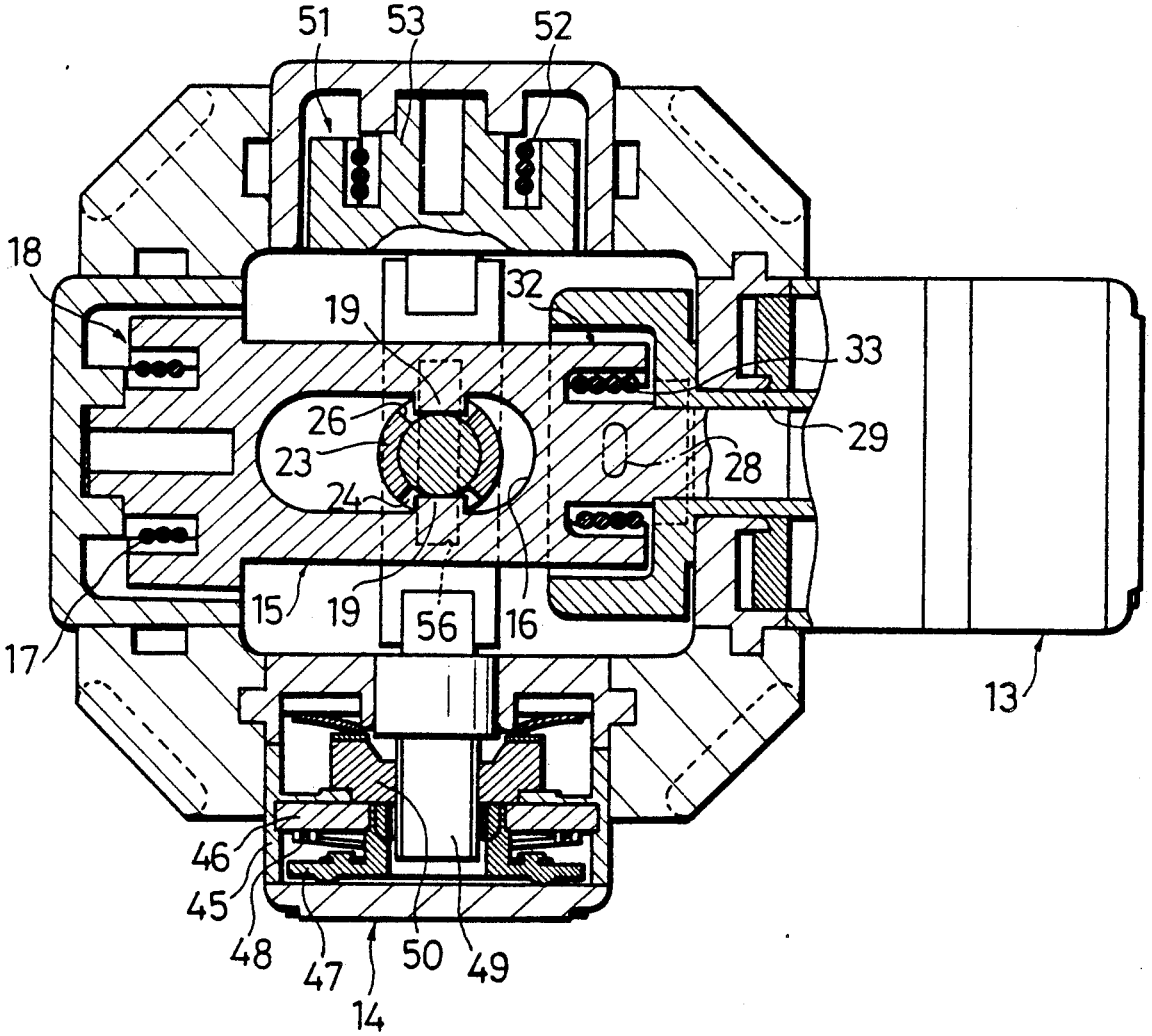
FIG. 2 is a plan view of the same device, partly cut away.
Figure 3:
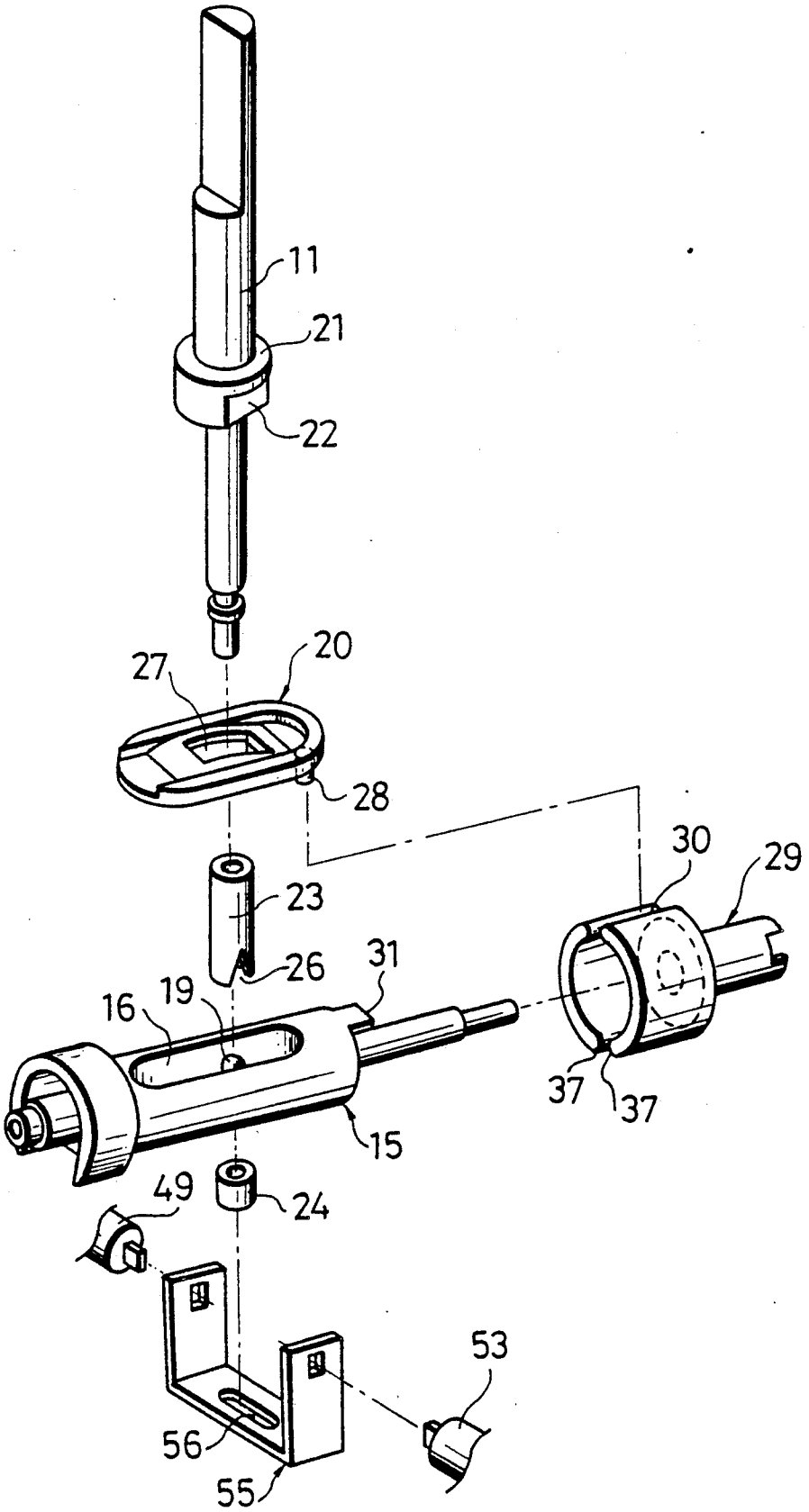
FIG. 3 is an exploded perspective view of various members in the neighborhood of the control lever.
Figure 4:
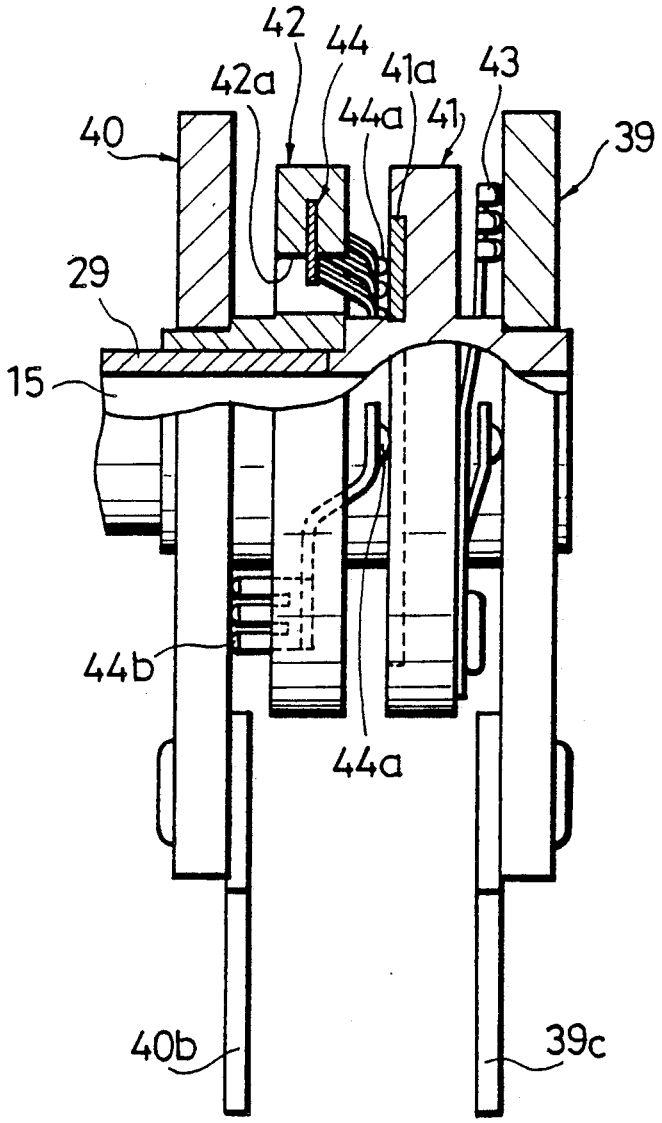
FIG. 4 is a cross-sectional view of principal parts of a variable resistor disposed at one end of the driving shaft.
Figure 9:
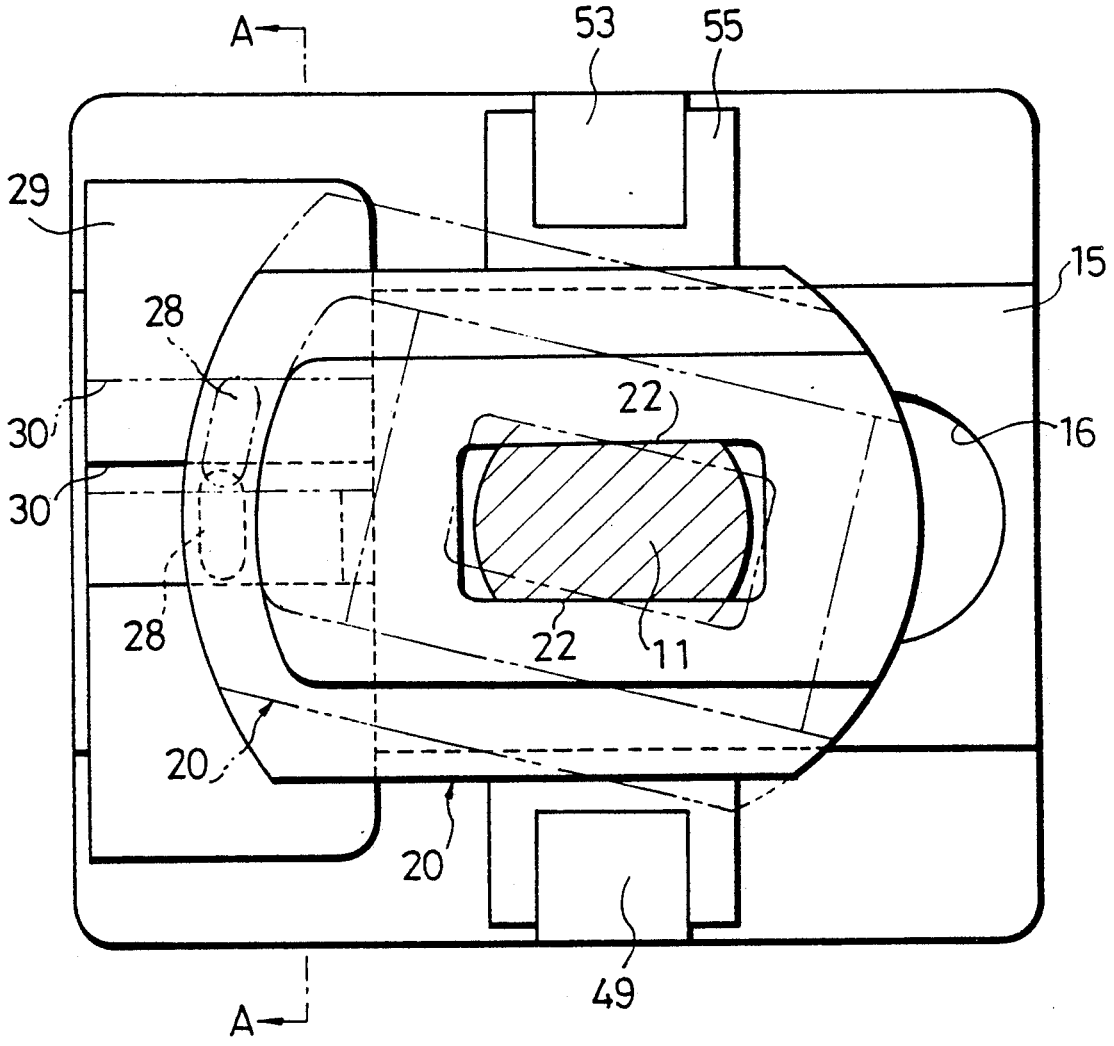
FIG. 9 is a plan view of principal parts excluding the casing.
Figure 10:
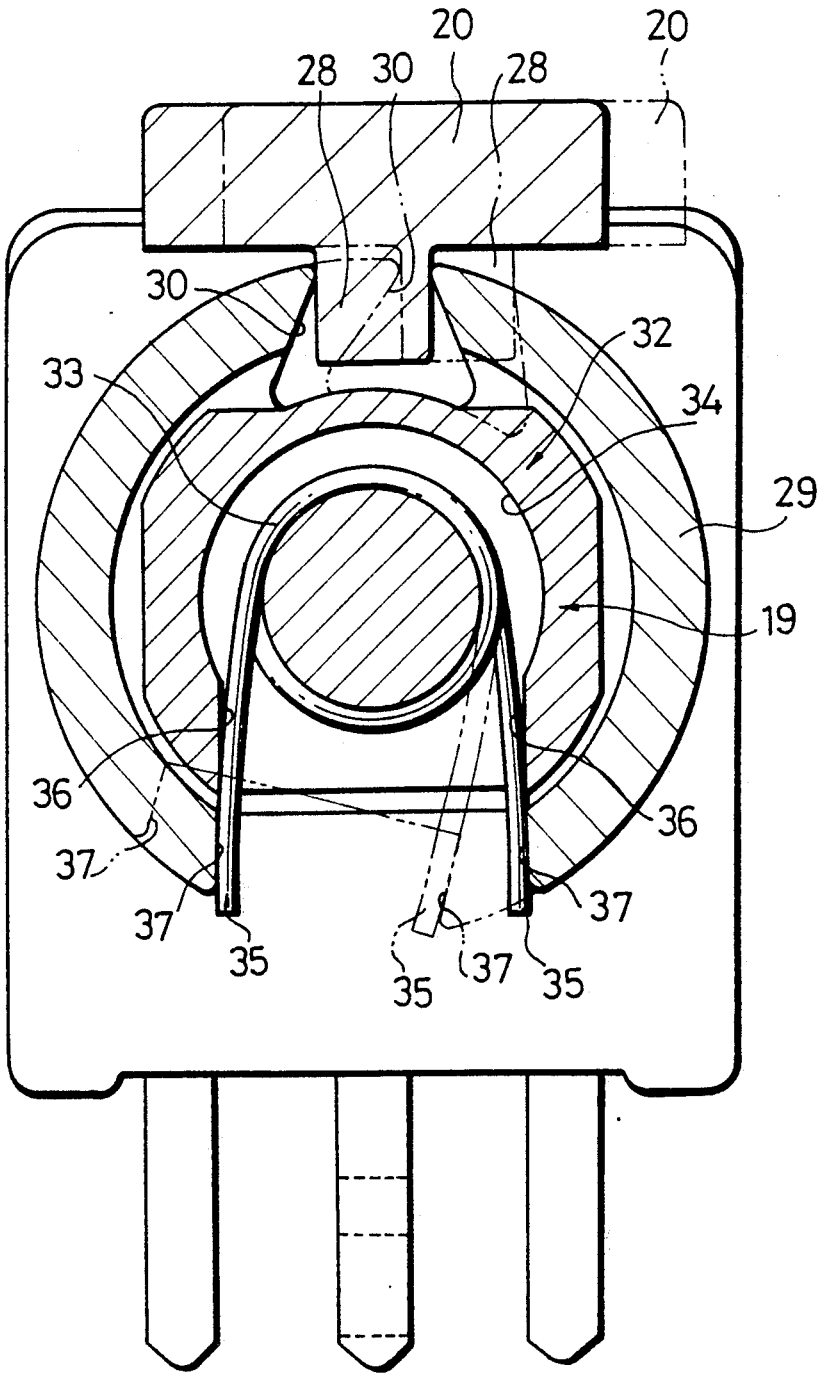
FIG. 10 is a cross-sectional view along the line 10—10 in FIG. 9.
Figure 11:
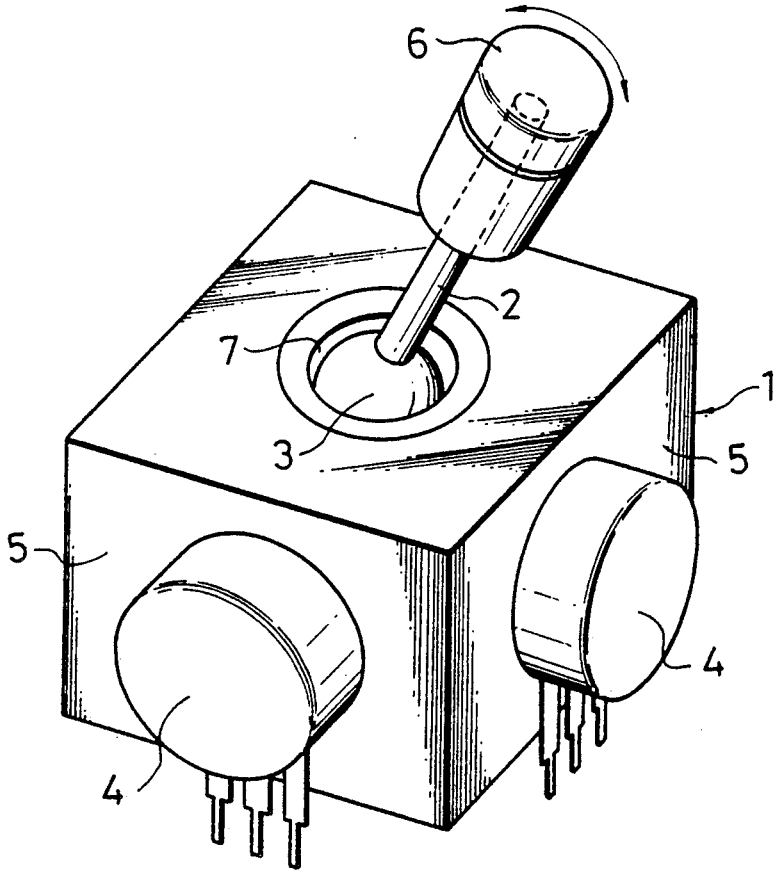
Fig. 11 PRIOR ART
FIG. 11 is a perspective view illustrating a prior art control lever type input device.

Starting from the state indicated in FIG. 2, when a force is applied clockwise to the control lever 11, the control lever 11 is rotated clockwise by using the rings 23 and 24 as bearings. This rotating operation of the control lever 11 is independent from the rotation of the driving shaft 15 and the small driving shaft 49. This rotating operation can be effected also in the state where the control lever 11 is inclined. When the control lever 11 is rotated as indicated in FIGS. 9 and 10, the working member 20 secured to the mounting portion 21 of the control lever 11 is rotated similarly clockwise. The outer shaft 29 is rotated clockwise against the spring force of the coil spring 33 of the automatic returning mechanism 32 through the working protrusion 28 and the engaging recess portion 30 by the rotation of this working member 20. The slider holder 42 of the outer shaft 29 is rotated by the rotation of this outer shaft 29. At this time, since the driving shaft 15 is not rotated, the slider holder 41 of the driving shaft 15 and the slider holder 42 of the outer shaft 29 are moved relatively. Thus the sliding portion **44*a* is slid on the contact pattern 41*a* so that the switch is turned on. This switch output is issued through the terminal 40*b*** to control the coordinate input.

When this rotating manipulation force on the control lever is removed, the outer shaft 29 is returned by the spring force of the coil spring 33 in the automatic returning mechanism 32. Thus it is returned to a predetermined position with respect to the driving shaft 15, i.e. to the position, where the relative positional deviation between the slider holders 41 and 42 of the outer shaft 29 and the driving shaft 15 is 0.

In the embodiment described above thus constructed, since the outer shaft 29 and the driving shaft are constructed in a two-shaft type; the slider holders 42 and 41 are mounted fixedly on the outer shaft 29 and the driving shaft 15, respectively; the base plates 39 and 40 are mounted fixedly on the case 38, opposite to the slider holders 41 and 42, respectively; on one surface of the slider holder 41, there is formed the contact pattern **41*a*; on the other surface, the slider 43 is mounted fixedly so as to be slid on the patterns 39*a* and 39*b* on the base plate 39; the sliders 44 formed to be bent on both the surfaces thereof are disposed on the slider holder 42; the slider portions 44*a* and 44*b* are slid on the contact pattern 41*a* and the pattern 40*a* on the base plate 40; and the working member 20 disposed on the control lever 11 is engaged with the outer shaft 29 so that the outer shaft 29 is rotated by the rotating movement of the control lever 11, when the control lever 11 is driven so as to be rotated, the driving shaft 15 is not rotated, but only the outer shaft 29 is rotated, which gives rise to relative positional deviations between the slider holder 41 of the driving shaft 15 and the slider holder 42 of the outer shaft 29. Consequently, the sliding portion 44*a* of the slider 44 is slid on the contact pattern 41*a* of the slider holder 41** so as to turn-on the switch and the coordinate input can be controlled by this switch output.

Further, according to the present invention, since the control lever 11 is held rotatably and at the same time the driving shaft 15 is inserted rotatably in the outer shaft 29; the variable resistors are disposed on this outer shaft 29 and the driving shaft 15, respectively; the working member 20 is engaged with the outer shaft 29; the rotational angle of the outer shaft 29 is made different from that of the driving shaft 15 by twisting the control lever 11 so as to rotate, the relative rotational angle of the outer shaft 29 with respect to the driving shaft 15 is deviated by twisting the control lever 11 so as to rotate, which gives rise finally to differences in the output of the variable resistors of the outer shaft 29 and the driving shaft 15. Therefore it is possible also to control the coordinate input by obtaining the switch output by detecting these differences in the output.

Further, since no switch is required in the knob portion of the control lever as required heretofore, the knob portion of the control lever 11 can be small and further it is possible to stabilize the quality without treatment of the harness.

As explained above, according to the present invention, the size of the knob of the control lever can be reduced and the quality can be stabilized without treatment of the harness.

What is claimed is:

1. A control lever type input device comprising:

a case;

a driving shaft rotatably mounted in said case, said driving shaft operably coupled to a first output means for producing a first output related to the rotation of said driving shaft;

an outer shaft rotatably mounted over said driving shaft, said outer shaft operably coupled to a second output means for producing a second output related to the rotation of said outer shaft; and a control lever pivotably and rotatably mounted in said case, said control lever having a portion extending outside of said case, said control lever being operably coupled to said driving shaft such that when said control lever is pivoted in a predetermined direction, said driving shaft is rotated, thereby producing said first output, said control lever also being operably coupled to said outer shaft such that when said control lever is rotated, said outer shaft is rotated about said driving shaft, thereby producing said second output.

2. A control lever type input device of claim 1 wherein said outer shaft and said driving shaft are operably coupled such that rotation of said driving shaft through a predetermined angle due to pivoting of said control lever causes said outer shaft to rotate through said predetermined angle, and rotation of said outer shaft due to rotation of said control lever occurs without a corresponding rotation of the

3. A control lever type input device of claim 1 wherein said first output means comprises:

a first base plate fixedly attached in said case, said first base plate having a first conductor pattern;

a first slider holder operably coupled to said driving shaft such that said slider holder is rotated with said driving shaft, said slider holder having a first slider disposed such that when said slider holder is turned, said first slider slides on said first conductor pattern, said slider holder also having a second conductor pattern disposed on a side opposite said first slider; and said second output means comprises:

a second base plate fixedly coupled to said case such that said outer shaft passes therethrough, said second base plate having a third conductor pattern;

a second slider holder operably coupled to said outer shaft such that said second slider holder is rotated with said outer shaft, said second slider holder having a second slider disposed on a first side of said second slider holder such that said second slider slides on said second conductor pattern when said outer shaft is rotated, said second slider holder also having a third slider disposed on a second side of said second slider holder such that when said second slider holder is rotated said third slider slides on said third conductor pattern.

4. A control lever type input device of claim 2 wherein said first output means comprises:

a first base plate fixedly attached in said case, said first base plate having a first conductor pattern;

a first slider holder operably coupled to said driving shaft such that said slider holder is rotated with said driving shaft, said slider holder having a first slider disposed such that when said slider holder is turned, said first slider slides on said first conductor pattern, said slider holder also having a second conductor pattern disposed on a side opposite said first slider; and said second output means comprises:

a second base plate fixedly attached in said case such that said outer shaft passes therethrough, said second base plate having a third conductor pattern;

a second slider holder operably coupled to said outer shaft such that said second slider holder is rotated with said outer shaft, said second slider holder having a second slider disposed on a first side of said second slider holder such that said second slider slides on said second conductor pattern when said outer shaft is rotated, said second slider holder also having a third slider disposed on a second side of said second slider holder such that when said second slider holder is rotated said third slider slides on said third conductor pattern.

5. A control lever type input device according to claim 1, wherein said outer shaft includes an engaging recess and wherein a working member is disposed on said control lever, said working member having an operating projection which engages said engaging recess such that rotation of said control lever causes said outer shaft to rotate about said driving shaft through the contact of said operating projection against said engaging recess.

6. A control lever type input device according to claim 2, wherein said outer shaft includes an engaging recess and wherein a working member is disposed on said control lever, said working member having an operating projection which engages said engaging recess such that rotation of said control lever causes said outer shaft to rotate about said driving shaft through the contact of said operating projection against said engaging recess.

7. A control lever type input device according to claim 1, further including resetting means for automatically resetting said ouer shaft to a neutral position and stopper means for limiting rotation of said outer shaft, said resetting means and stopper means being interposed between said outer shaft and said inner shaft.

* * * * *